US006577070B2

(12) United States Patent
Hirao et al.

(10) Patent No.: US 6,577,070 B2
(45) Date of Patent: Jun. 10, 2003

(54) AC TYPE PLASMA DISPLAY PANEL

(75) Inventors: Kazunori Hirao, Osaka (JP); Kenji Kiriyama, Hyogo (JP); Koji Aoto, Osaka (JP); Yoshihito Tahara, Osaka (JP); Taichi Shino, Nara (JP); Koichi Wani, Osaka (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 10/066,913

(22) Filed: Feb. 4, 2002

(65) Prior Publication Data

US 2002/0070676 A1 Jun. 13, 2002

Related U.S. Application Data

(63) Continuation of application No. 09/601,761, filed as application No. PCT/JP99/06462 on Nov. 18, 1999, now Pat. No. 6,424,095.

(51) Int. Cl.[7] ..... G09G 3/10

(52) U.S. Cl. ..... 315/169.4; 315/169.1

(58) Field of Search ..... 315/169.1, 169.3, 315/169.4; 313/581, 582, 585; 345/72, 83

(56) References Cited

U.S. PATENT DOCUMENTS

| | | | | |
|---|---|---|---|---|
| 5,994,829 | A | 11/1999 | Gorog et al. | 313/461 |
| 5,994,929 | A | 11/1999 | Sano et al. | 313/461 |
| 6,156,433 | A | 12/2000 | Hatori et al. | 428/411.1 |
| 6,211,614 | B1 * | 4/2001 | Katayama et al. | 313/582 |
| 6,242,860 | B1 | 6/2001 | Sasao et al. | 313/586 |
| 6,242,864 | B1 * | 6/2001 | Nakahara et al. | 315/169.3 |
| 6,294,875 | B1 | 9/2001 | Kurata et al. | 315/169.1 |
| 6,424,095 | B1 * | 7/2002 | Hirao et al. | 315/169.4 |

FOREIGN PATENT DOCUMENTS

| | | |
|---|---|---|
| JP | 6-175607 | 6/1994 |
| JP | 8-190869 | 7/1996 |
| JP | 9-115466 | 5/1997 |
| JP | 10-188819 | 7/1998 |
| JP | 10-207419 | 8/1998 |
| JP | 10-301529 | 11/1998 |
| JP | 10-308179 | 11/1998 |
| JP | 11-176337 | 7/1999 |
| JP | 11-185631 | 7/1999 |
| JP | 11-297212 | 10/1999 |
| WO | 97/11477 | 3/1997 |

* cited by examiner

*Primary Examiner*—Don Wong
*Assistant Examiner*—Jimmy T. Vu
(74) *Attorney, Agent, or Firm*—Merchant & Gould, P.C.

(57) ABSTRACT

An AC type plasma display panel is designed so as to have the relationships of Wb>Wg>Wr and Db>Dg>Dr, where Wb, Wg and Wr denote the widths of blue, green and red discharge cells and Db, Dg and Dr denote the widths of address electrodes (15*b*, 15*g* and 15*r*) corresponding to respective colors. As a result, it is possible to adjust the electric charge stored in the discharge cells due to a write discharge according to colors, thereby making complete lighting write voltages of the discharge cells uniform. This achieves the AC type plasma display panel with an excellent display quality that has less occurrence of erroneous discharge and discharge flicker and an improved white display quality.

4 Claims, 13 Drawing Sheets

AC TYPE PLASMA DISPLAY PANEL

This application is a continuation of 09/601,761 filed Aug. 7, 2000 now U.S. Pat. No. 6,424,095 which is a PCT/5899/06462 filed Nov. 18, 1999.

TECHNICAL FIELD

The present invention relates to an AC type plasma display panel used for displaying images in a television receiver and a billboard.

BACKGROUND ART

FIG. 11 is a partially broken perspective view illustrating a schematic configuration of a conventional AC type plasma display panel (hereinafter, simply referred to as "a panel"). FIG. 12 is a cross sectional view of FIG. 11 taken along the line B—B in an arrow direction.

As is shown in FIG. 11, the conventional AC type plasma display panel 80 is provided with a front substrate 82 and a back substrate 83 opposing each other and separated by a discharge space. On the front substrate 82, a plurality of pairs of stripe-shaped scanning electrodes 86 and sustaining electrodes 87 are arranged substantially in parallel and covered with a dielectric layer 84 and a protective coating 85. A plurality of stripe-shaped address electrodes 88 are formed substantially in parallel on the back substrate 83 in the direction perpendicular to the scanning electrode 86 and the sustaining electrode 87. Stripe-shaped barriers 89 are arranged between the address electrodes 88. Phosphors 90 are formed between the barriers 89 so as to cover the address electrodes 88. Spaces surrounded by the surface substrate 82, the back substrate 83 and the barriers 89 form discharge cells 91. The spaces in the discharge cells 91 are filled with gases radiating ultraviolet light due to discharge.

As is shown in FIG. 12, the phosphor 90 includes a blue phosphor 90*b*, a green phosphor 90*g* and a red phosphor 90*r*, and one of these three colors of phosphors is formed in each discharge cell. Thus, the discharge cell provided with the blue phosphor 90*b* constitutes a blue discharge cell 91*b*, the discharge cell provided with the green phosphor 90*g* constitutes a green discharge cell 91*g*, and the discharge cell provided with the red phosphor 90*r* constitutes a red discharge cell 91*r*.

Next, a method for displaying an image data on the conventional panel 80 is described.

When driving the panel 80, one field period is divided into subfields having the weight of emission period based on a binary system so that gradation is displayed by a combination of subfields for light emission. For example, when one field is divided into eight subfields, 256 gradation levels can be displayed. The subfield includes an initialization period, an address period and a sustain period.

In order to display an image data, signal waveforms that are different in each period, i.e., the initialization period, the address period or the sustain period, are applied to the electrodes.

In the initialization period, for example, a positive polarity pulse voltage with respect to the address electrode 88 is applied to all the scanning electrodes 86 so as to store wall charge on the protective coating 85 and the phosphors 90.

In the address period, while a negative polarity pulse is being applied to the scanning electrodes 86 so as to scan the scanning electrodes 86 sequentially, a positive polarity pulse (a write voltage) is applied to the address electrodes 88. A discharge (a write discharge) occurs in the discharge cell 91 at the intersection of the scanning electrode 86 and the address electrode 88, generating charged particles. This is called a write operation.

In the subsequent sustain period, AC voltage that is sufficient to sustain the discharge is applied between the scanning electrode 86 and the sustaining electrode 87 for a certain period. Discharge plasma generated at the intersection of the scanning electrode 86 and the address electrode 88 excites the phosphor 90 so as to emit light while applying this AC voltage between the scanning electrode 86 and the sustaining electrode 87. Where light emission is not desired, it may be possible not to apply the pulse to the scanning electrodes 86 in the address period.

In these conventional panels described above, for the purpose of obtaining white similar to that with chromaticity coordinates of a standard white light source, the width of the discharge cell 91 (that is, the distance between barriers 89 on both sides constituting the discharge cell 91) is different from that with the other two colors (JP 9-115466 A). Specifically, the discharge cell 91*b* having the blue phosphor 90*b* is the widest, and the green discharge cell 91*g* and the red discharge cell 91*r* are narrower than the blue discharge cell 91*b*. The reason for this configuration is as follows. The luminous efficiency of the blue phosphor 90*b* is lower than those of the green phosphor 90*g* and the red phosphor 90*r*. Therefore, when all the widths of blue, green and red discharge cells are the same, the maximum input signal input into the discharge cells of respective colors cannot obtain the desired chromaticity and color temperature. For example, the chromaticity obtained from synthesizing the three colors deviates from the white range or its color temperature is low. Accordingly, the width of the discharge cell 91 is made different from that with the other two colors so that the maximum input signal input into the discharge cells of respective colors can obtain the desired white.

However, the above-described configuration has a problem in that the discharge starting voltage of the blue discharge cell 91*b* is different from those of the other two discharge cells 91*g* and 91*r*. FIG. 13 shows write voltages necessary to perform a write discharge in a stable manner when a constant voltage is applied to the scanning electrodes 86 in the write operation in the address period (complete lighting write voltages) with respect to the discharge cells of respective colors. As is described above, in the conventional panel, the discharge cells have necessary write voltages that are different from color to color. As a result, as is clearly shown in the figure, the discharge cells have complete lighting write voltages that are considerably different depending on their colors. Thus, applying the same write voltage to all the discharge cells causes problems of an unstable write discharge, erroneous discharge or discharge flicker, leading to an improper display.

In order to perform a stable write operation, it is necessary that the write voltage to be applied to the address electrodes 88 is changed depending on colors of the discharge cells in accordance with the complete lighting write voltage of the discharge cells of respective colors. However, this complicates the voltage control, raising the cost of the apparatus.

DISCLOSURE OF INVENTION

It is an object of the present invention to solve the problems above and to provide an AC type plasma display panel that achieves a stable write discharge even when blue, green and red discharge cells have different widths from each other, as well as prevents erroneous discharge and discharge flicker so as to realize a proper display.

In order to achieve the above-mentioned object, the present invention has the following configuration.

An AC type plasma display panel in accordance with the first configuration of the present invention includes two substrates opposing each other with barriers interposed therebetween, a plurality of discharge cells surrounded by the two substrates and the barriers, and a phosphor formed in each of the discharge cells. A width of the discharge cell in which the phosphor having at least one color of a plurality of colors is formed is different from a width of the discharge cell in which the phosphor having another color is formed. The AC type plasma display panel has a function of making complete lighting write voltages of the discharge cells in which the phosphors of respective colors are formed substantially uniform. "The complete lighting write voltage" in the present invention means a write voltage necessary to cause a write discharge in all of the desired discharge cells in a write operation in an address period followed by a sustain operation. Since the complete lighting write voltages of the discharge cells are substantially uniform among colors, this configuration provides the AC type plasma display panel with an excellent display quality that achieves a stable write discharge and prevents erroneous discharge and discharge flicker so as to realize a proper display in a stable manner. In addition, the width of the discharge cell can be changed as desired according to colors, making it possible to obtain the AC type plasma display panel with an improved white display quality that has desired chromaticity and color temperature.

In the first configuration above, it is preferable that an address electrode is formed on one of the two substrates in the discharge cell, and W1 is larger than W2 and D1 is larger than D2, where W1 is the width of the discharge cell in which the phosphor having one color of the plurality of colors is formed, D1 is a width of the address electrode formed in this discharge cell, W2 is the width of the discharge cell in which the phosphor having a color different from the phosphor formed in the discharge cell with the width W1 is formed, and D2 is a width of the address electrode formed in this discharge cell. With this configuration, since the width of the address electrode is changed according to that of the discharge cell (this substantially corresponds to the volume of the discharge space of each discharge cell), an electric charge formed by a write discharge in each discharge cell can be changed according to the volume of the discharge space of each discharge cell. As a result, the complete lighting write voltages of the discharge cells can be made substantially uniform among colors.

In the above configuration, it is preferable that r1 substantially equals r2, where r1 is the ratio of the W1 to the D1 and r2 is the ratio of the W2 to the D2. With this configuration, the volume of the discharge space of each discharge cell and the electric charge formed by a write discharge in each discharge cell can correspond to each other in a more precise manner.

Also, in the above configuration, it is preferable that a blue phosphor is formed in the discharge cell having the width W1, and a green phosphor or a red phosphor is formed in the discharge cell having the width W2. With this configuration, higher chromaticity of white emission can be achieved, thereby realizing a white display with an excellent quality.

In addition, in the first configuration above, it is preferable that an address electrode is formed on one of the two substrates in the discharge cell, a sustaining electrode and a scanning electrode are formed on the other substrate in the direction perpendicular to the address electrode, and a voltage waveform having an inclined portion changing gradually is applied to the address electrode, the sustaining electrode or the scanning electrode in an initialization period followed by an address period. With this configuration, a voltage being applied to the discharge space at the time the initialization period is completed can be made substantially equal to the discharge starting voltage of the discharge cell. As a result, the complete lighting write voltages of the discharge cells can be made substantially uniform among colors.

In the above configuration, it is preferable that the inclined portion has a portion of voltage increase and a portion of voltage decrease. With this configuration, a simple voltage control can drive the panel in a stable manner.

Also, in the above configuration, it is preferable that the inclined portion has a portion of a voltage change rate that is 10 V/$\mu$s or smaller. This configuration can stably obtain the effect that a voltage being applied to the discharge space at the time the initialization period is completed can be made substantially equal to the discharge starting voltage of the discharge cell.

In addition, in the first configuration above, it is preferable that a residual voltage in the discharge cell is made substantially equal to a discharge starting voltage of the discharge cell at the time an initialization period followed by an address period is completed. With this configuration, the complete lighting write voltages of the discharge cells can be made substantially uniform among colors.

An AC type plasma display panel in accordance with the second configuration of the present invention includes a front substrate and a back substrate opposing each other with barriers interposed therebetween, a plurality of discharge cells surrounded by the front substrate, the back substrate and the barriers, and an address electrode and a blue, green or red phosphor are formed on the back substrate in the discharge cell. W1 is larger than W2 and D1 is larger than D2, where W1 is a width of the discharge cell in which one of the blue, green and red phosphors is formed, and D1 is a width of the address electrode formed in this discharge cell, and W2 is a width of the discharge cell in which the phosphor having a color different from the phosphor formed in the discharge cell with the width W1 is formed, and D2 is a width of the address electrode formed in this discharge cell. With this configuration, since the width of the address electrode is changed according to that of the discharge cell (this substantially corresponds to the volume of the discharge space of each discharge cell), an electric charge formed by a write discharge in each discharge cell can be changed according to the volume of the discharge space of each discharge cell. As a result, when the widths of the discharge cells are different from color to color, the AC type plasma display panel with an excellent display quality that achieves a stable write discharge and prevents erroneous discharge and discharge flicker so as to realize a proper display in a stable manner can be obtained. In addition, the width of the discharge cell can be changed as desired according to colors, making it possible to obtain the AC type plasma display panel with an improved white display quality that has desired chromaticity and color temperature.

In the second configuration above, it is preferable that r1 substantially equals r2, where r1 is the ratio of the W1 to the D1 and r2 is the ratio of the W2 to the D2. With this configuration, the volume of the discharge space of each discharge cell and the electric charge formed by a write discharge in each discharge cell can correspond to each other in a more precise manner.

Also, in the second configuration above, it is preferable that a blue phosphor is formed in the discharge cell having the width W1, and a green phosphor or a red phosphor is formed in the discharge cell having the width W2. With this configuration, higher chromaticity of white emission can be achieved, thereby realizing a white display with an excellent quality.

An AC type plasma display panel in accordance with the third configuration of the present invention includes two substrates opposing each other with barriers interposed therebetween, an address electrode formed on one of the two substrates, a sustaining electrode and a scanning electrode that are formed on the other substrate in the direction perpendicular to the address electrode, a plurality of discharge cells surrounded by the two substrates and the barriers, and a blue, green or red phosphor formed in each of the discharge cells. A width of the discharge cell in which the phosphor having at least one color of blue, green and red is formed is different from a width of the discharge cells in which the phosphors having other colors are formed. A voltage waveform having an inclined portion changing gradually is applied to the address electrode, the sustaining electrode or the scanning electrode in an initialization period followed by an address period. With this configuration, a voltage being applied to the discharge space at the time the initialization period is completed can be made substantially equal to the discharge starting voltage of the discharge cell. As a result, when the widths of the discharge cells are different from color to color, the AC type plasma display panel with an excellent display quality that achieves a stable write discharge and prevents erroneous discharge and discharge flicker so as to realize a proper display in a stable manner can be obtained. In addition, the width of the discharge cell can be changed as desired according to colors, making it possible to obtain the AC type plasma display panel with an improved white display quality that has desired chromaticity and color temperature.

In the third configuration above, it is preferable that the inclined portion has a portion of voltage increase and a portion of voltage decrease. With this configuration, a simple voltage control can drive the panel in a stable manner.

Also, in the third configuration above, it is preferable that the inclined portion has a portion of a voltage change rate that is 10 V/$\mu$s or smaller. This configuration can stably obtain the effect that a voltage being applied to the discharge space at the time the initialization period is completed can be made substantially equal to the discharge starting voltage of the discharge cell.

Moreover, an AC type plasma display panel in accordance with the fourth configuration of the present invention includes two substrates opposing each other with barriers interposed therebetween, a plurality of discharge cells surrounded by the two substrates and the barriers, and a phosphor formed in each of the discharge cell. A width of the discharge cell in which the phosphor having at least one color of a plurality of colors is formed is different from a width of the discharge cell in which the phosphor having another color is formed. A residual voltage in the discharge cell is made substantially equal to a discharge starting voltage of the discharge cell at the time an initialization period followed by an address period is completed. With this configuration, the complete lighting write voltages of the discharge cells are made substantially uniform among colors. As a result, when the widths of the discharge cells are different from color to color, the AC type plasma display panel with an excellent display quality that achieves a stable write discharge and prevents erroneous discharge and discharge flicker so as to realize a proper display in a stable manner can be obtained. In addition, the width of the discharge cell can be changed as desired according to colors, making it possible to obtain the AC type plasma display panel with an improved white display quality that has desired chromaticity and color temperature.

BEST MODE FOR CARRYING OUT THE INVENTION (First Embodiment)

The following is a description of the first embodiment of the present invention, with reference to the accompanying drawings.

Figure 1:
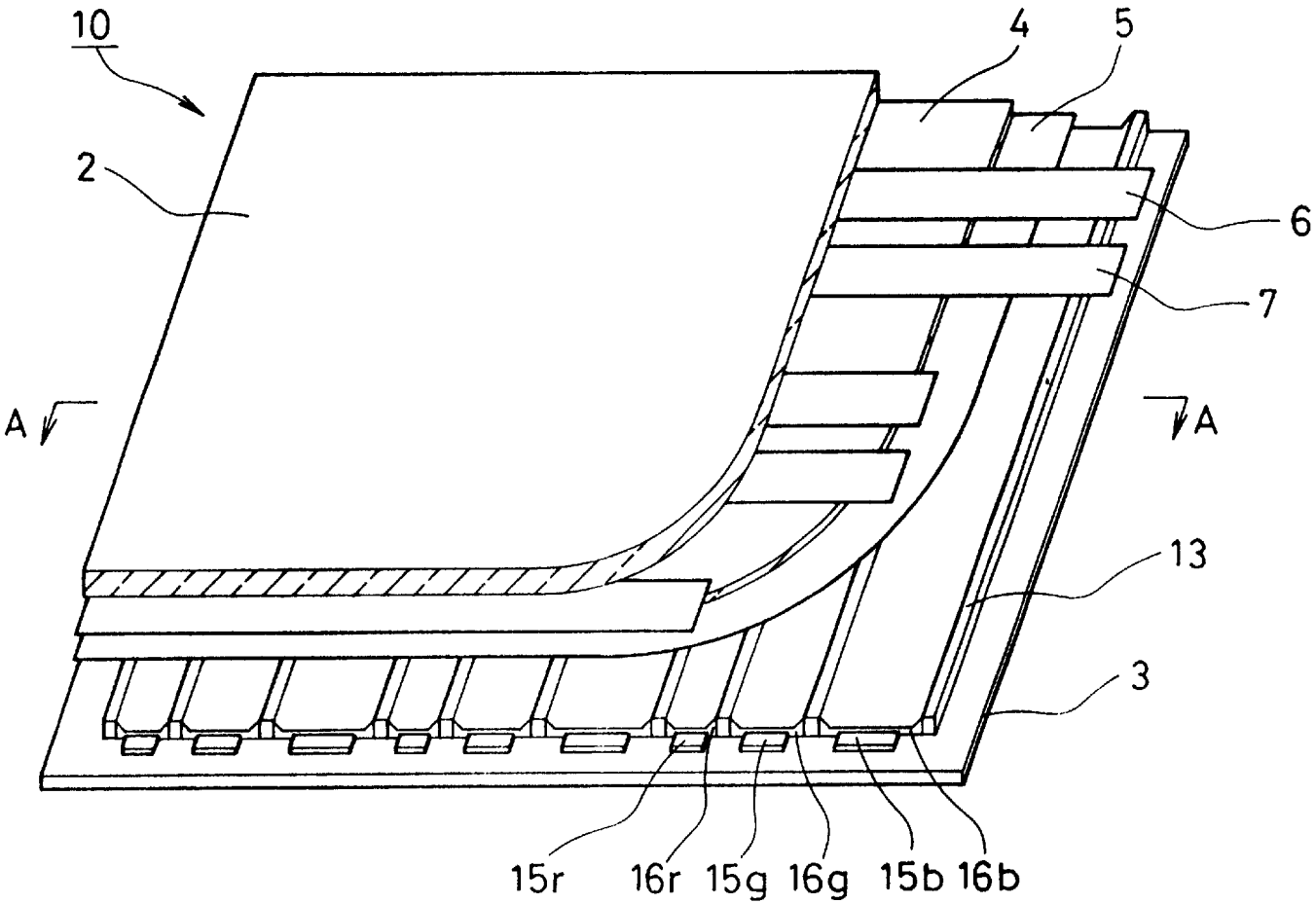
FIG. 1 is a partially broken perspective view illustrating an AC type plasma display panel of the first embodiment of the present invention.
Figure 2:
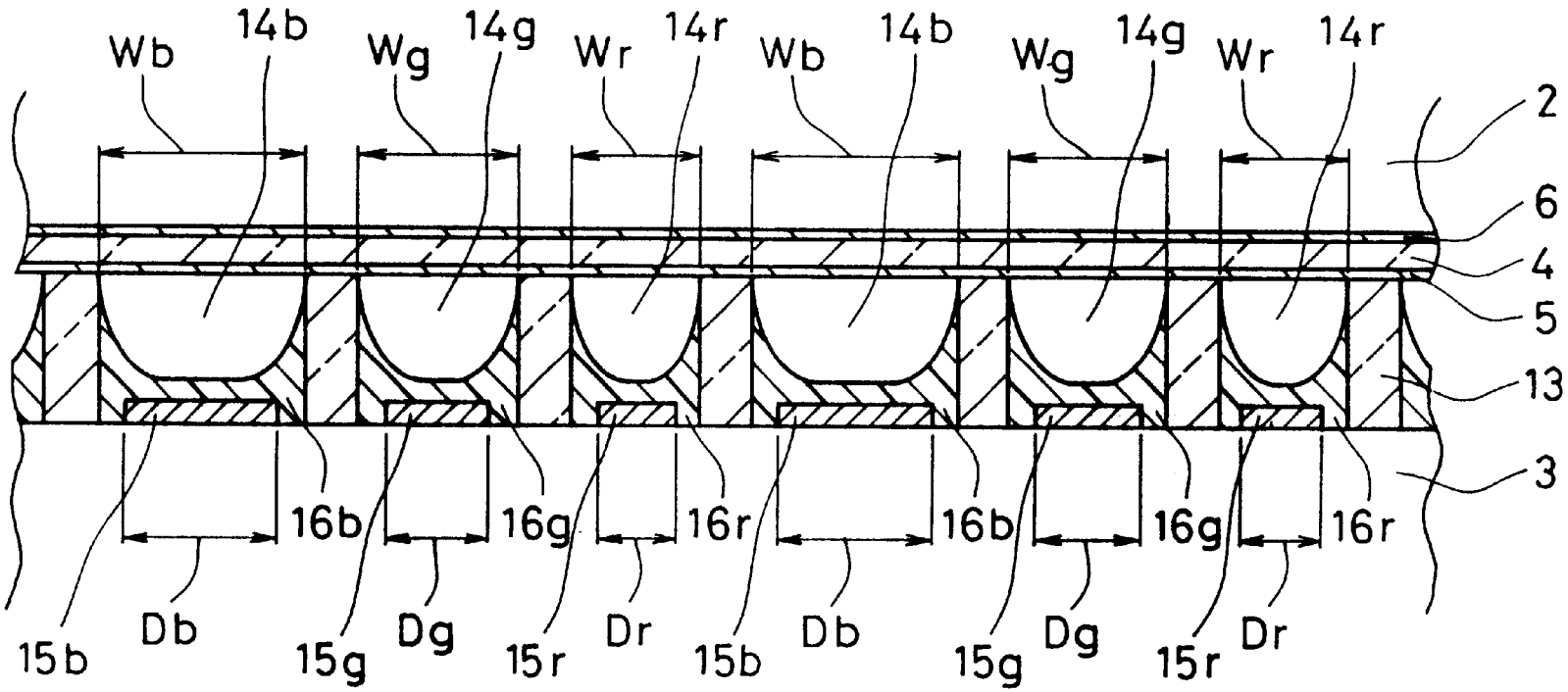
FIG. 2 is a cross sectional view of FIG. 1 along the line A—A taken in an arrow direction.

FIG. 1 is a partially broken perspective view illustrating an AC type plasma display panel (hereinafter, simply referred to as "a panel") according to the first embodiment of the present invention. FIG. 2 is a cross sectional view of FIG. 1 along the line A—A taken in an arrow direction.

As is shown in FIG. 1, a panel 10 of the present embodiment is provided with a front substrate 2 and a back substrate 3 opposing each other separated by a discharge space. On the front substrate 2 made of a transparent material such as a glass, a plurality of pairs of stripe-shaped scanning electrodes 6 and sustaining electrodes 7 are arranged substantially in parallel with each other and covered with a dielectric layer 4 and a protective coating 5. Stripe-shaped (belt-like) barriers 13 are arranged between the front substrate 2 and the back substrate 3 in the direction perpendicular to the scanning electrode 6 and the sustaining electrode 7. In the spaces surrounded by the surface substrate 2, the back substrate 3 and the barriers 13, a blue discharge cell 14*b*, a green discharge cell 14*g* and a red discharge cell 14*r* are formed sequentially, as shown in FIG. 2.

Between the adjacent barriers 13, stripe-shaped address electrodes 15*b*, 15*g* and 15*r* corresponding to the discharge cells 14*b*, 14*g* and 14*r* with respective colors are formed in parallel with the barriers 13, and a blue phosphor 16*b*, a green phosphor 16*g* and a red phosphor 16*r* are formed on the address electrodes 15*b*, 15*g* and 15*r* toward the sides of the barriers 13 on both sides. Mixed gas of xenon and at least one of helium, neon and argon is sealed in the discharge cells 14*b*, 14*g* and 14*r*.

The address electrode 15*b* formed in the blue discharge cell 14*b* is called a blue address electrode 15*b*, the address electrode 15*g* formed in the green discharge cell 14*g* is called a green address electrode 15*g*, and the address electrode 15*r* formed in the red discharge cell 14*r* is called a red address electrode 15*r*.

As is shown in FIG. 2, when the distance between the barriers 13 constituting the blue discharge cell 14*b*, i.e., the width of the blue discharge cell, is expressed by Wb, the distance between the barriers 13 constituting the green discharge cell 14*g*, i.e., the width of the green discharge cell, is expressed by Wg, and the distance between the barriers 13 constituting the red discharge cell 14*r*, i.e., the width of the red discharge cell, is expressed by Wr, they are designed so as to satisfy Wb>Wg>Wr. Also, when the width of the blue address electrode 15*b* is expressed by Db, that of the green address electrode 15*g* by Dg, and that of the red address electrode 15*r* by Dr, they are designed so as to satisfy Db>Dg>Dr. In addition, the address electrodes 15*b*, 15*g* and 15*r* are arranged so as to be located substantially in the center of the discharge cells 14*b*, 14*g* and 14*r*.

Next, the following is a description of the operation of displaying discharge emission of the panel in accordance with the present embodiment, with reference to FIGS. 1 and 2.

First, in a write operation, a positive write pulse voltage (a write voltage) is applied to the address electrodes 15*b*, 15*g* and 15*r*, and a negative scan pulse voltage is applied to the scanning electrodes 6, so that a write discharge occurs in the discharge cells 14*b*, 14*g* and 14*r*, thus storing positive charge on the surface of the protective coating 5 on the scanning electrodes 6.

In a subsequent sustain operation, first, a negative sustain pulse voltage is applied to the sustaining electrodes 7, then a negative sustain pulse voltage is applied to the scanning electrodes 6 and the sustaining electrodes 7 alternately, so as to maintain the sustain discharge. Finally, a negative erase pulse voltage is applied to the sustaining electrodes 7 so as to stop this sustain discharge.

As a specific example of the panel 10 of the present embodiment, the discharge cells have widths of Wb1=0.37 mm, Wg1=0.28 mm and Wr1=0.19 mm, the barrier 13 has a width of 0.08 mm, and the blue, green and red address electrodes have widths of Db1=0.222 mm, Dg1=0.168 mm and Dr1=0.114 mm so as to be in proportion to the widths of the discharge cells of respective colors. The electric charges formed on the surfaces of the protective coating 5 in the blue, green and red discharge cells during the display operation are expressed by Qb1, Qg1 and Qr1.

As is shown in FIG. 1, the volume ratio of the discharge spaces of the blue, green and red discharge cells approximately can be regarded as the width ratio of the discharge cells of corresponding colors. Therefore, the volume ratio mentioned above is Wb1:Wg1:Wr1=5:4:3. Also, the ratio of the electric charges formed on the surfaces of the protective coating 5 in the blue, green and red discharge cells during the display operation expressed by Qb1:Qg1:Qr1 substantially corresponds to the width ratio of the address electrodes, namely Db1:Dg1:Dr1. Therefore, the relationship of Qb1:Qg1: Qr1=5:4:3 is satisfied. Consequently, the surfaces of the protective coating 5 in the blue, green and red discharge cells 14*b*, 14*g* and 14*r* obtain the electric charges Qb1, Qg1 and Qr1 that substantially correspond to the volume ratio of the discharge spaces of the discharge cells of corresponding colors. As a result, the panel with less occurrence of erroneous discharge and with excellent display characteristics can be obtained.

For a comparative example, the blue, green and red discharge cells are designed to have widths of Wb2=0.37 mm, Wg2=0.28 mm and Wr2=0.19 mm, as in the panel of the specific example of the present embodiment, and all the address electrodes in the discharge cells of different colors are designed to have widths of Db2=Dg2=Dr2=0.18 mm. In this panel, the ratio of the electric charges formed on the surfaces of the protective coating 5 in the blue, green and red discharge cells during the display operation expressed by Qb2:Qg2:Qr2 equals the width ratio of the address electrodes, namely Db2:Dg2:Dr2. In other words, Qb2:Qg2:Qr2=1:1:1 is satisfied, so the electric charges stored on the surfaces of the protective coating 5 in the discharge cells of respective colors are not in proportion to the volume ratio of the discharge spaces of the corresponding discharge cells. In this case, a discharge becomes unstable in the blue discharge cell 14*b* that is the widest discharge cell, causing erroneous discharge or discharge flicker.

Figure 3:
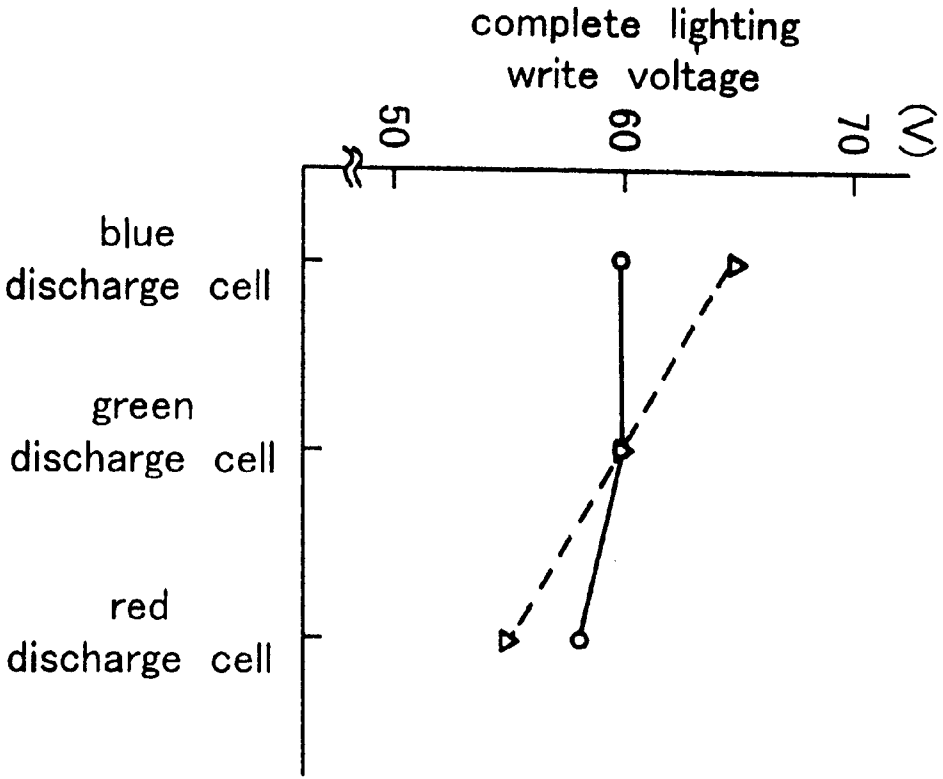
FIG. 3 is a graph showing complete lighting write voltages of the plasma display panel of the first embodiment and that of the comparative example with respect to the discharge cells of respective colors.

Next, FIG. 3 shows the result of measuring write voltages that can perform a write discharge stably in a write operation (complete lighting write voltages) with respect to the panels of the specific example and the comparative example of the present embodiment described above. In FIG. 3, a solid line denotes the measurement result in the panel of the specific example of the present embodiment, and a dashed line denotes that of the comparative example of the present embodiment. In the following description, complete lighting write voltages of the blue, green and red discharge cells are expressed by Vbd, Vgd and Vrd.

As shown in FIG. 3, in the panel of the comparative example, the complete lighting write voltages of the blue, green and red discharge cells are Vbd>Vgd>Vrd, indicating the large difference between their voltages. In order to operate discharge display in such panels in a stable manner, it is necessary that a write voltage is designed to be higher than the complete lighting write voltage of the blue discharge cell Vbd that is the highest complete lighting write voltage among those of the discharge cells of all colors. In this case, since a voltage that is at least 10 V higher than Vrd will be applied to the red discharge cell having the lowest complete lighting write voltage, the discharge becomes unstable, causing flicker and erroneous write operation.

On the other hand, as shown in FIG. 3, in the panel of the specific example of the present embodiment, since the discharge cells of all colors have substantially the same complete lighting write voltages Vbd, Vgd and Vrd, the write operations become uniform among the discharge cells of all colors, thus preventing flicker of display emission and occurrence of erroneous write operation.

Thus, the address electrodes 15*b*, 15*g* and 15*r* are designed to have appropriate widths so that the electric charges corresponding to the volumes of the discharge spaces of the blue, green and red discharge cells are stored on the surfaces of the protective coating 5 in the discharge cells of corresponding colors during the display operation, thereby obtaining the panel that achieves a stable display discharge without erroneous discharge and discharge flicker.

The present embodiment described the case where the discharge cells have widths of Wb>Wg>Wr. However, even if the widths of the discharge cells have another relationship with each other, the panel that achieves a stable display discharge without erroneous discharge and discharge flicker can be obtained by designing the widths of the address electrodes so as to be in proportion to those of the discharge cells in which these address electrodes are formed. Also, the present embodiment described the case where the widths of the address electrodes in the discharge cells of respective colors are designed so as to be in proportion to those of the discharge cells, but simply designing the widths of the address electrodes so as to be in the order of the widths of the discharge cells also can obtain a panel that achieves a stable display discharge without erroneous discharge and discharge flicker.

(Second Embodiment)

The following is a description of the second embodiment of the present invention, with reference to accompanying drawings.

Figure 4:
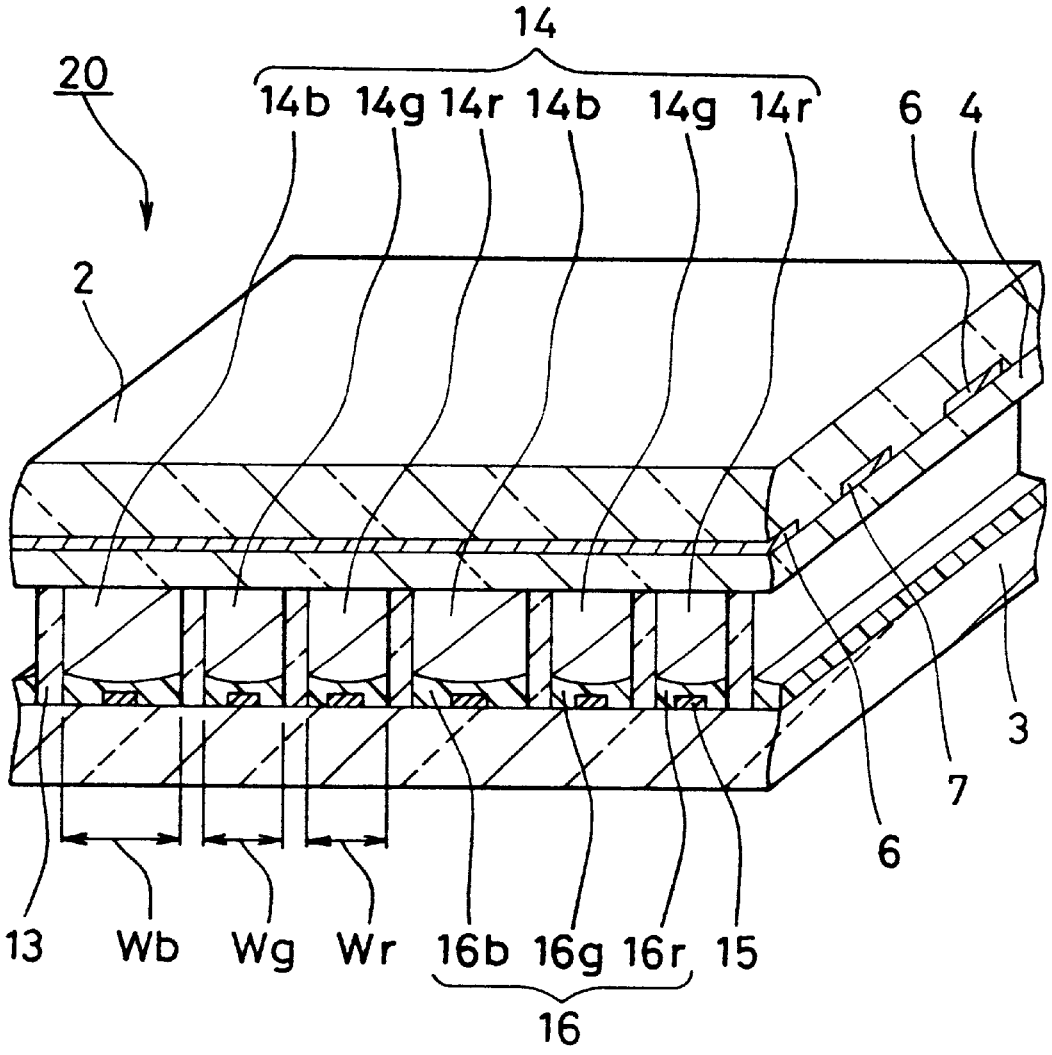
FIG. 4 is a cross sectional view illustrating an AC type plasma display panel of the second embodiment of the present invention.

FIG. 4 is a cross sectional view in the width direction illustrating an AC type plasma display panel (hereinafter, simply referred to as "a panel") of the first embodiment of the present invention.

As is shown in FIG. 4, a panel 20 of the present embodiment is provided with a front substrate 2 and a back substrate 3 opposing each other with a predetermined space therebetween, and the space is filled with gases radiating ultraviolet light due to discharge, for example, neon and xenon. On the front substrate 2, a group of display electrodes including belt-like scanning electrodes 6 and sustaining electrodes 7 are formed substantially in parallel, which are further covered with a dielectric layer 4. Although not in the figure, a protective layer may be formed on the dielectric layer 4 as in the first embodiment. On the back substrate 3, address electrodes 15 are formed in the direction perpendicular to the scanning electrode 6 and the sustaining electrode 7. A plurality of belt-like barriers 13 are provided between the surface substrate 2 and the back substrate 3 in parallel to the address electrode 15.

Between the adjacent barriers 13, one of phosphors 16 of a blue phosphor 16*b*, a green phosphor 16*g* and a red phosphor 16*r* is provided on the back substrate 3 so as to cover the address electrode 15 sequentially. A discharge cell 14 is formed in the space surrounded by the surface substrate 2, the back substrate 3 and the barriers 13, and the discharge cell provided with the blue phosphor 16*b* is called a blue discharge cell 14*b*, the discharge cell provided with the green phosphor 16*g* is called a green discharge cell 14*g* and the discharge cell provided with the red phosphor 16*r* is called a red discharge cell 14*r*.

Figure 5:
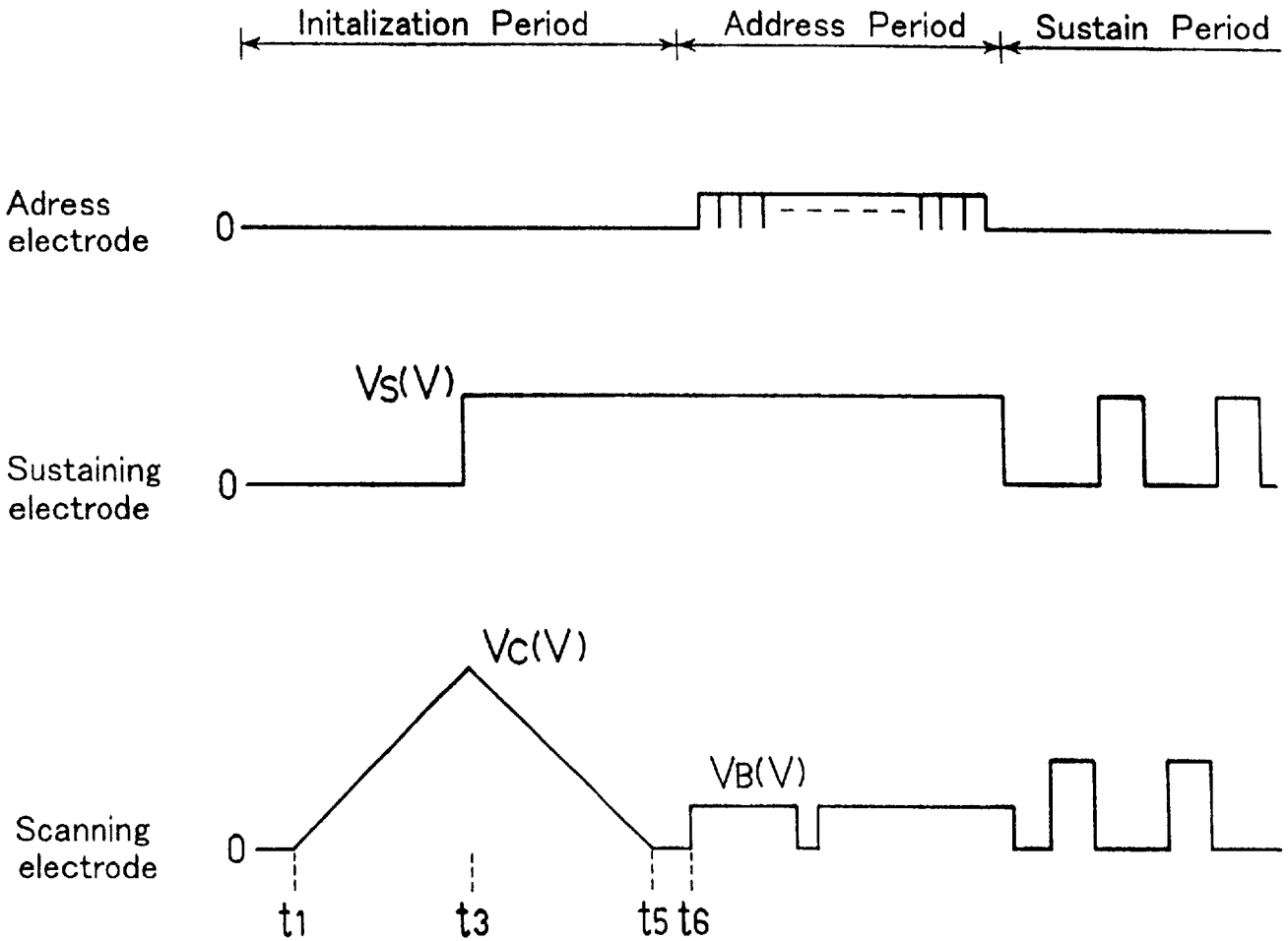
FIG. 5 is a chart showing drive voltage waveforms of the AC type plasma display panel of the second embodiment.

The following is a description of a method for driving the panel 20 for displaying an image data on the panel 20 of the present embodiment with reference to FIG. 5.

A method similar to the conventional one is used as the method for driving the panel 20, that is, one field period is divided into subfields having the weight of emission period based on a binary system so that gradation is displayed by a combination of subfields for light emission. The subfield includes an initialization period, an address period and a sustain period.

FIG. 5 shows voltage waveforms to be applied to the electrodes. As is shown in FIG. 5, in the initialization period, voltage having a waveform that gradually increases and then decreases with respect to the sustaining electrode 7 and the address electrode 15 (inclined voltage) is applied to all the scanning electrodes 6, so that wall charge is stored on the dielectric layer 6 and the phosphors 16.

In the address period, a positive polarity pulse according to display data is applied to the address electrodes 15, and a negative polarity pulse is applied to the scanning electrodes 6 sequentially. This causes a write discharge (address discharge) in the discharge cell 14 at the intersection of the address electrode 15 and the scanning electrode 6, generating charged particles. A positive polarity pulse is not applied to the address electrodes 15 corresponding to the discharge cell 14 with no data to be displayed.

In the subsequent sustain period, AC voltage that is sufficient to sustain the discharge is applied between the scanning electrode 6 and the sustaining electrode 7 for a certain period, generating discharge plasma in the discharge cell 14 in which the write discharge (address discharge) occurred. The discharge plasma generated as above excites the phosphors 16 so as to emit light, thereby displaying data on the panel.

In the present embodiment, $BaMgAl_{10}O_{17}$; Eu is used as the blue phosphor 16*b*, $Zn_2SiO_4$; Mn is used as the green phosphor 16*g*, and $(Y_2Gd)BO_3$; Eu is used as the red phosphor 16*r*. The blue discharge cell 14*b* has a width Wb of 0.37 mm, the green discharge cell 14*g* has a width Wg of 0.28 mm, the red discharge cell 14*r* has a width Wr of 0.19 mm, the barrier 13 has a width of 0.08 mm, and the total width of these discharge cells of three colors is 1.08 mm. In this case, the chromaticity of the white emission obtained by synthesizing emissions of phosphors of these three colors was on the Planckian locus of substantially 10,000 K, realizing a white display with an excellent quality.

Figure 6:
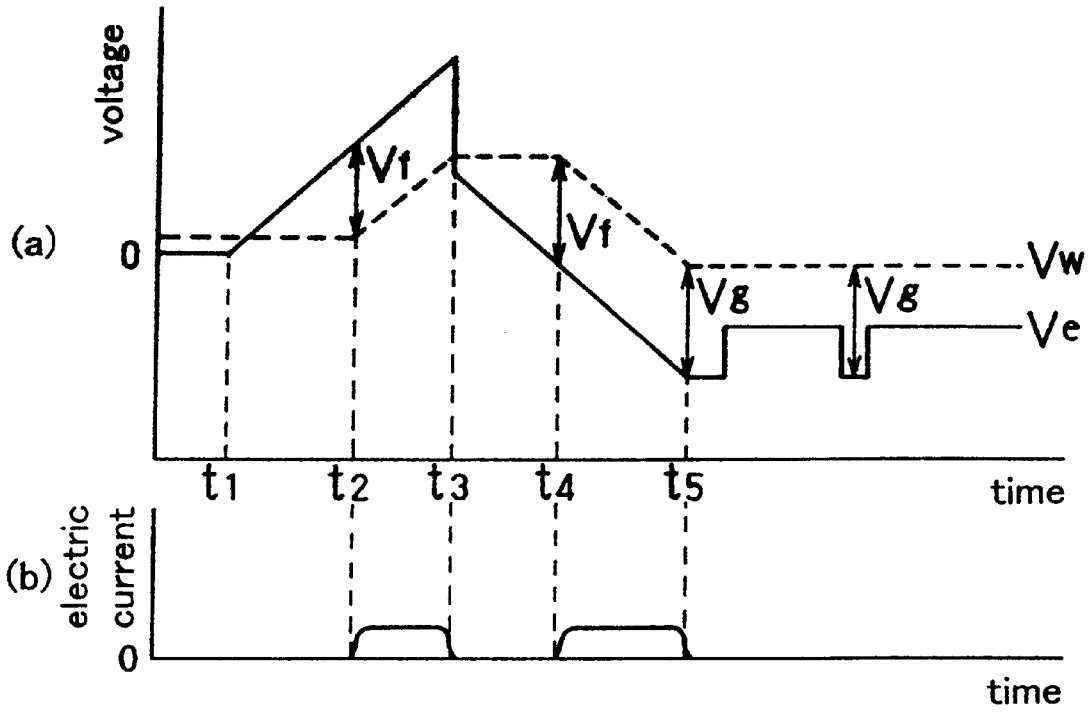
FIGS. 6(*a*) and (*b*) are graphs for explaining the wall voltage change of a discharge cell in the second embodiment.

Next, the following is a description of the wall voltage change of a discharge cell from the initialization period to the address period, with reference to FIGS. 5 and 6. In FIG. 6(*a*), a solid line indicates a relative electric potential Ve (V) of the scanning electrode 6 with respect to the sustaining electrode 7, and a dashed line indicates a wall voltage Vw (V) that is stored on the dielectric layer 4. The voltage being applied to the discharge space is expressed by the difference between Ve and Vw, i.e., Ve−Vw. FIG. 6(*b*) shows an electric current Is flowing in the discharge space.

From time t1 to t3 that is in the first half of the initialization period, an inclined voltage gradually increasing from 0 to Vc (V) is applied to the scanning electrode 6 as is shown in FIG. 5. A discharge occurs at time t2 when the voltage Ve−Vw being applied to the discharge space reaches the discharge starting voltage Vf (V) or higher, and the wall voltage Vw increases along with the increase of the relative electric potential Ve. Next, at time t3, the electric potential of the sustaining electrode 7 is raised to Vs (V). As a result, the relative electric potential Ve decreases, so that the voltage Ve−Vw being applied to the discharge space decreases to that lower than the discharge starting voltage Vf, and thus the discharge stops. Subsequently, an inclined voltage in which the electric potential of the scanning electrode 6 gradually decreases from Vc to 0 is applied to the scanning electrode 6. The relative electric potential Ve decreases along with the application of such an inclined voltage, so that the discharge starts again at time t4 when the absolute value of the voltage Ve−Vw being applied to the discharge space reaches the discharge starting voltage Vf or higher. Due to this discharge starting from time t4, the wall voltage Vw also decreases gradually, and then the discharge stops at time t5 when the voltage to be applied to the scanning electrode 6 becomes 0. At this time, a residual voltage Vg=Vw−Ve is being applied to the discharge space, reaching a stable state.

Since the electric current Is (A) flowing at the time a discharge occurs in the initialization period is in proportion to dVe/dt, the change rate of voltage applied to the scanning electrode 6, namely dVe/dt, is made sufficiently small, thereby keeping the electric current Is very low. Also, the wall voltage Vw is generated because a wall charge is formed on the dielectric layer 4 due to a discharge. Therefore, when a gradually inclined voltage is applied, the wall charge begins to be formed from the time the voltage Ve−Vw being applied to the discharge space exceeds the discharge starting voltage Vf, and keeps increasing substantially in proportion to the increase of voltage applied to the scanning electrode 6. Then, when the voltage applied to the scanning electrode 6 is lowered gradually, the wall charge begins to decrease from the time the absolute value of the voltage Ve−Vw being applied to the discharge space exceeds the discharge starting voltage Vf, and keeps decreasing substantially in proportion to the decrease of voltage applied to the scanning electrode 6. Consequently, the residual voltage Vg and the discharge starting voltage Vf are equal to each other at time t5. After time t5, the residual voltage Vg may change slightly because the residual charged particle in the discharge space is stored as wall charge. However, the change is slight because the electric current Is is very low, thus keeping the relationship of Vg≈Vf even after time t5.

Figure 7:
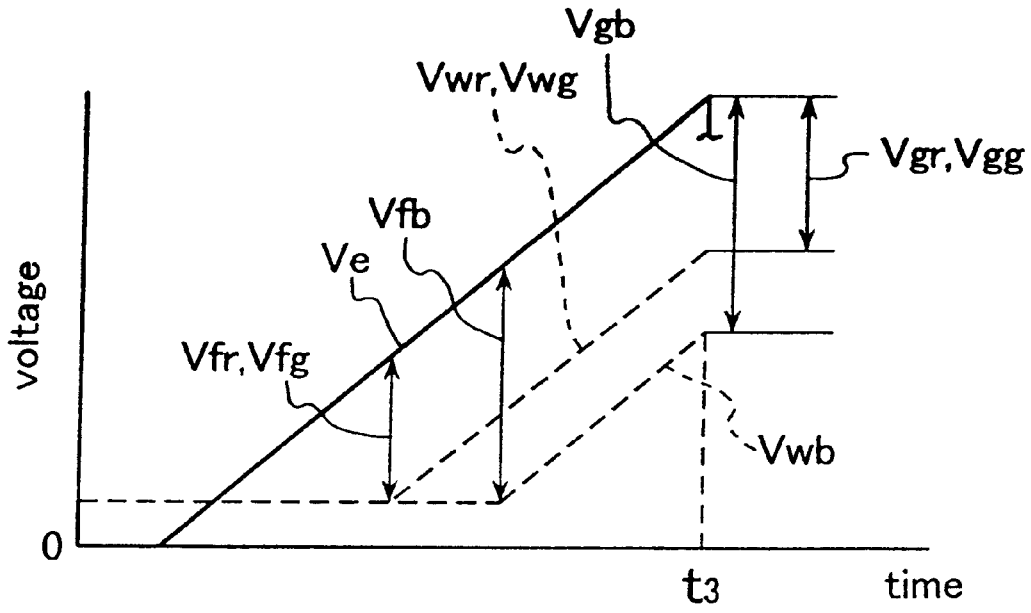
FIG. 7 is a graph for explaining the wall voltage change of the discharge cells of respective colors in the initialization period of the second embodiment.

FIG. 7 shows a detailed relationship between a relative electric potential Ve and a residual voltage Vg when an inclined voltage is applied to the scanning electrode. In FIG. 7, dotted lines indicate changes of wall voltages Vwb, Vwr and Vwg of the blue, red and green discharge cells when a discharge starting voltage Vfb of the blue discharge cell is different from discharge starting voltages Vfr and Vfg of the red and green discharge cells as in the present embodiment. A solid line indicates a relative electric potential Ve of the scanning electrode 6 with respect to the sustaining electrode 7 when an inclined voltage is applied to the scanning electrode 6. Since the blue discharge cell has a high discharge starting voltage Vfb, its discharge begins later than those of the red and green discharge cells as shown in FIG. 7. However, the discharges of all three colors of discharge cells stop at the same time (time t3 in FIG. 6), so the residual voltage Vgb of the blue discharge cell is the highest, achieving Vgb≈Vfb. Similarly, the residual voltages Vgr and Vgg of the red and green discharge cells achieve the relationships of Vgr≈Vfr and Vgg≈Vfg. When a voltage applied to the scanning electrode 6 is lowered gradually, as is similar to above, the discharge of the blue discharge cell begins later than those of the red and green discharge cells. However, the discharges of all three colors of discharge cells stop at the same time (time t5 in FIG. 6), so the residual voltage Vgb of the blue discharge cell is the highest, achieving Vgb≈Vfb. Similarly, the residual voltages Vgr and Vgg of the red and green discharge cells achieve the relationships of Vgr≈Vfr and Vgg≈Vfg.

Thus, as is shown in the above description, the voltage being applied to the discharge space of the discharge cell of each color at the end of the initialization period (this equals the residual voltage) substantially equals the discharge starting voltage of the corresponding discharge cell. Accordingly, at the beginning of the address period, the electric potential of the scanning electrode 6 is raised to a bias potential VB (V) once at time t6, as shown in FIG. 5, thereby preventing the occurrence of erroneous discharge. Then, synchronizing with the time a positive polarity pulse (write voltage) is applied to the address electrode 15, the electric potential of the scanning electrode 6 is lowered back to 0 (V), thereby applying a scan pulse to the scanning electrode 6 (write operation). During this time, the wall voltage stored in the dielectric layer 4 is kept unchanged, so by lowering the electric potential of the scanning electrode 6 back to 0 (V), the voltage that substantially equals the discharge starting voltage of the corresponding discharge cell is applied to the discharge cells. Accordingly, synchronizing with above, a pulse of a certain value is applied to the address electrodes 15, thereby starting the write discharge in the discharge cells of respective colors in a similar manner.

Figure 8:
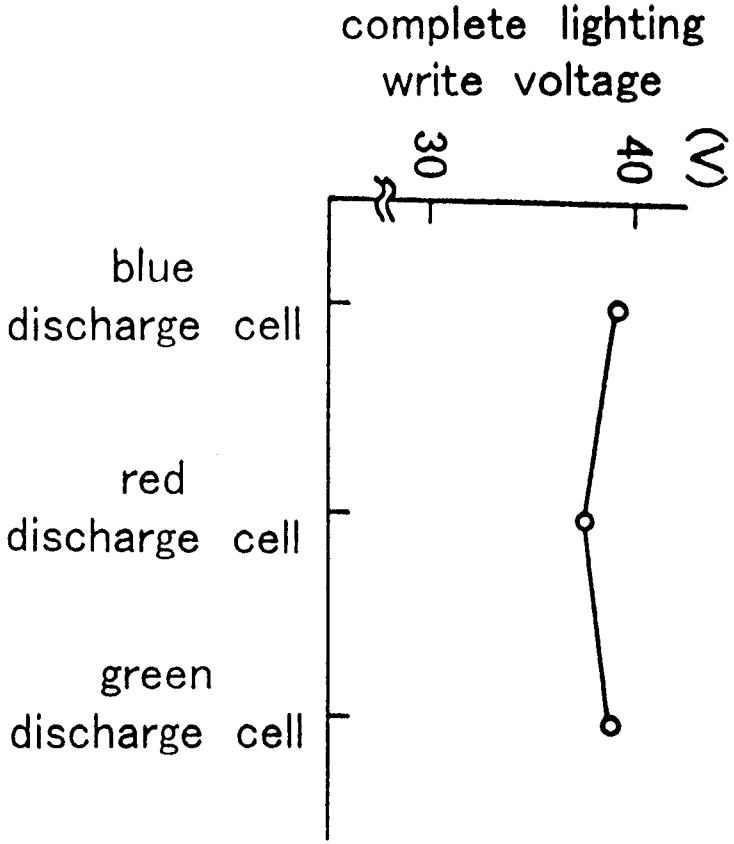
FIG. 8 is a graph showing complete lighting write voltages of the plasma display panel of the second embodiment with respect to the discharge cells of respective colors.

FIG. 8 shows the result of measuring write voltages that can perform a write discharge stably in above write operation (complete lighting write voltages), using the panel of the present embodiment. In this case, Vs=190 (V), Vc=450 (V), VB=100 (V), t5−t1=1 (ms), and Vc/(t5−t3)=0.7 (V/μs). With the present embodiment, since the discharge cells of all colors have substantially the same complete lighting write voltages, the write operations become uniform among the discharge cells of all colors, thus preventing flicker of the display emission and the occurrence of erroneous write operation. This indicates that a stable write operation (address operation) can be achieved.

Furthermore, as is shown in FIG. 8, in the panel of the present embodiment, the minimum voltage necessary for writing on the discharge cells of respective colors is lower than 40 V, which is considerably lower compared with that close to 100 V necessary for the conventional panel. Therefore, a low cost IC can be used for a write pulse generating circuit.

Figure 9:
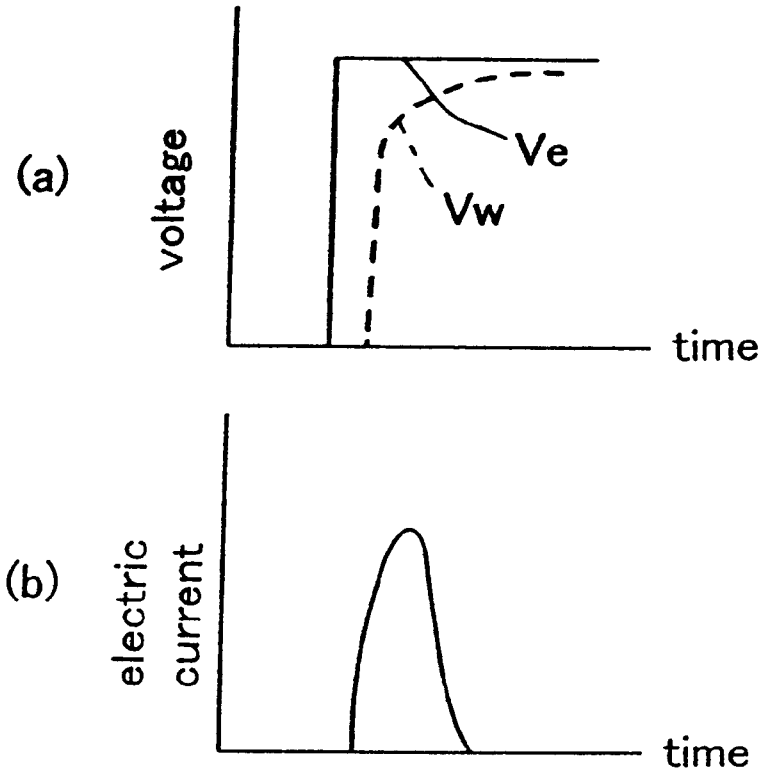
FIGS. 9(*a*) and (*b*) are graphs showing the wall voltage change in the initialization period of a conventional AC type plasma display panel.

For comparison, FIG. 9(*a*) shows a relationship between a relative electric potential Ve of the scanning electrode 6 with respect to the sustaining electrode 7 and a wall voltage Vw when a pulse voltage is applied to the scanning electrode 6 in the initialization period so as to form a wall charge as in the conventional panel. Also, FIG. 9(*b*) shows electric current flowing in the discharge space at this time. When a pulse voltage that rises sharply is applied to the scanning electrode 6, a discharge starts instantaneously, and at the same time large electric current flows. Therefore, a wall voltage Vw stored in the dielectric layer 4 also rises sharply, damping the voltage applied to the discharge space, and the discharge current flows in a pulse manner and then stops. Since many charged particles remain in the space even after the discharge current stops, a wall charge is formed until the voltage Ve−Vw being applied to the discharge space becomes 0 finally.

Figure 13:
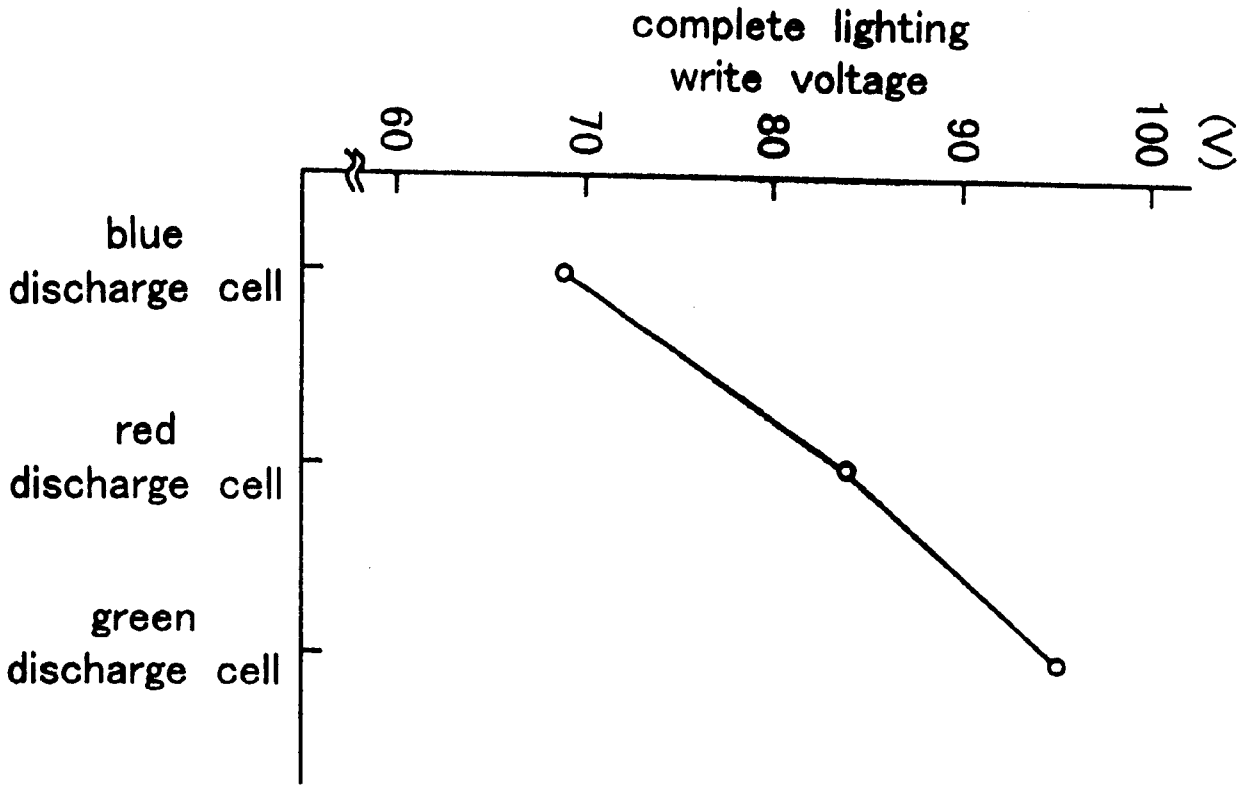
FIG. 13 is a graph showing complete lighting write voltages of the conventional plasma display panel with respect to the discharge cells of respective colors.

Thus, the wall voltage formed in the initialization period in the conventional panel is determined by the size of an initialization pulse and irrelevant to a discharge starting voltage of a discharge cell. Accordingly, as is shown in FIG. 13, the discharge cells have the complete lighting write voltages that are considerably different depending on their colors. In order to perform a stable write operation, it is necessary that the write voltage required in the address period (address voltage) Va is changed in accordance with the discharge starting voltage of the discharge cells of respective colors.

According to the result of the experiment of various panel designs conducted by the inventors, when the gradient of the inclined voltage is 10 V/μs or smaller in the initialization period, the effect described in the present embodiment was confirmed. As is described above, a voltage waveform that increases or decreases gradually in the initialization period is applied, thereby driving the panel with the configuration of the present embodiment in a stable manner.

Also, a stable address operation can be achieved as long as the gradient of the inclined voltage in the initialization period does not decrease to 0. However, since one field time is about 16 ms when displaying 256 gradation levels, the gradient of the inclined voltage is limited to that of 0.5 V/μs or larger in practice.

As is described above, the present embodiment can provide an AC type plasma display panel that improves the quality of white display, as well as can perform a stable write operation even if the write voltage (address voltage) is made uniform in the discharge cells of all colors in the address period, thereby realizing a stable display.

Figure 10:
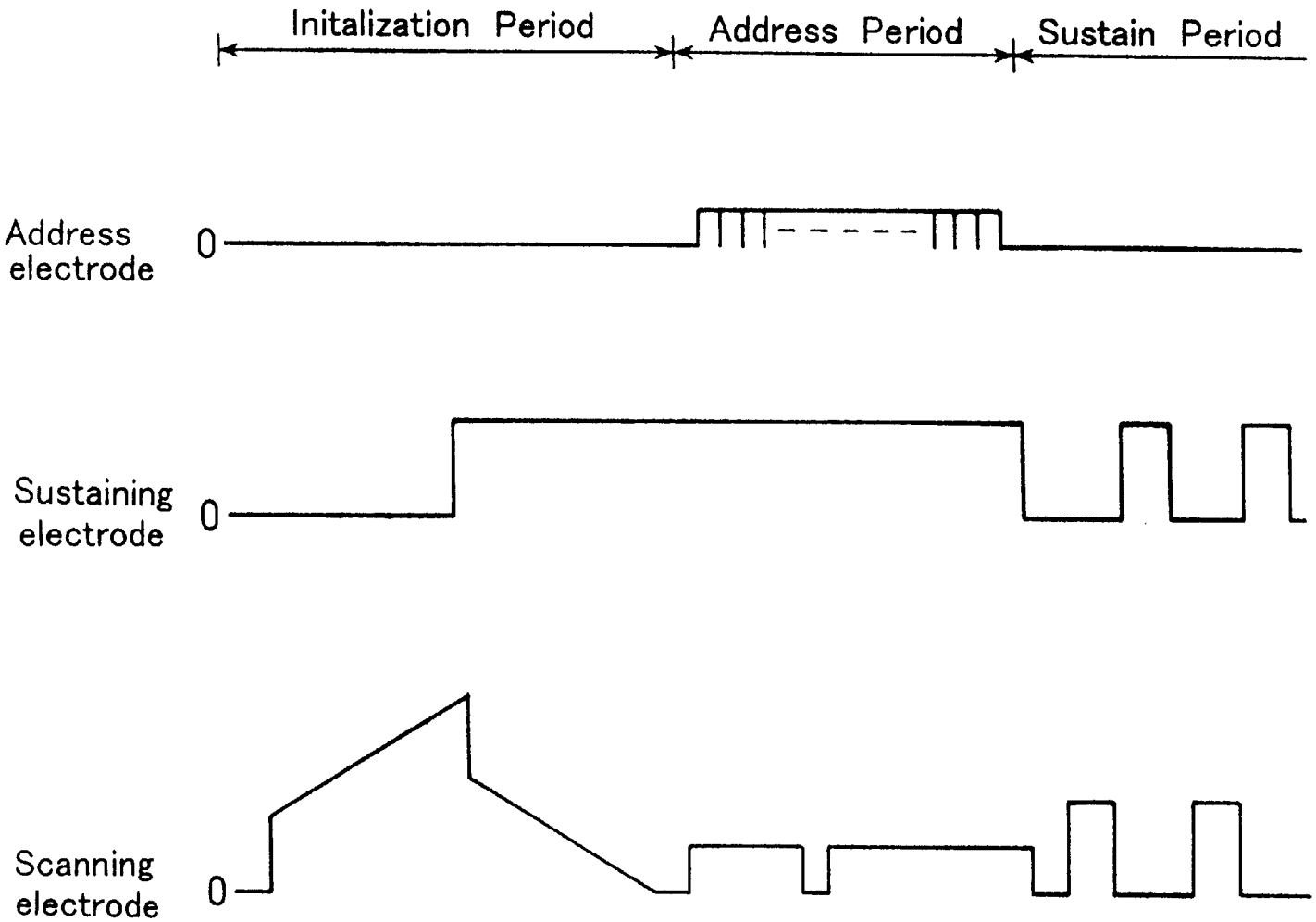
FIG. 10 is a chart showing drive voltage waveforms of the AC type plasma display panel according to another example of the second embodiment of the present invention.
Figure 11:
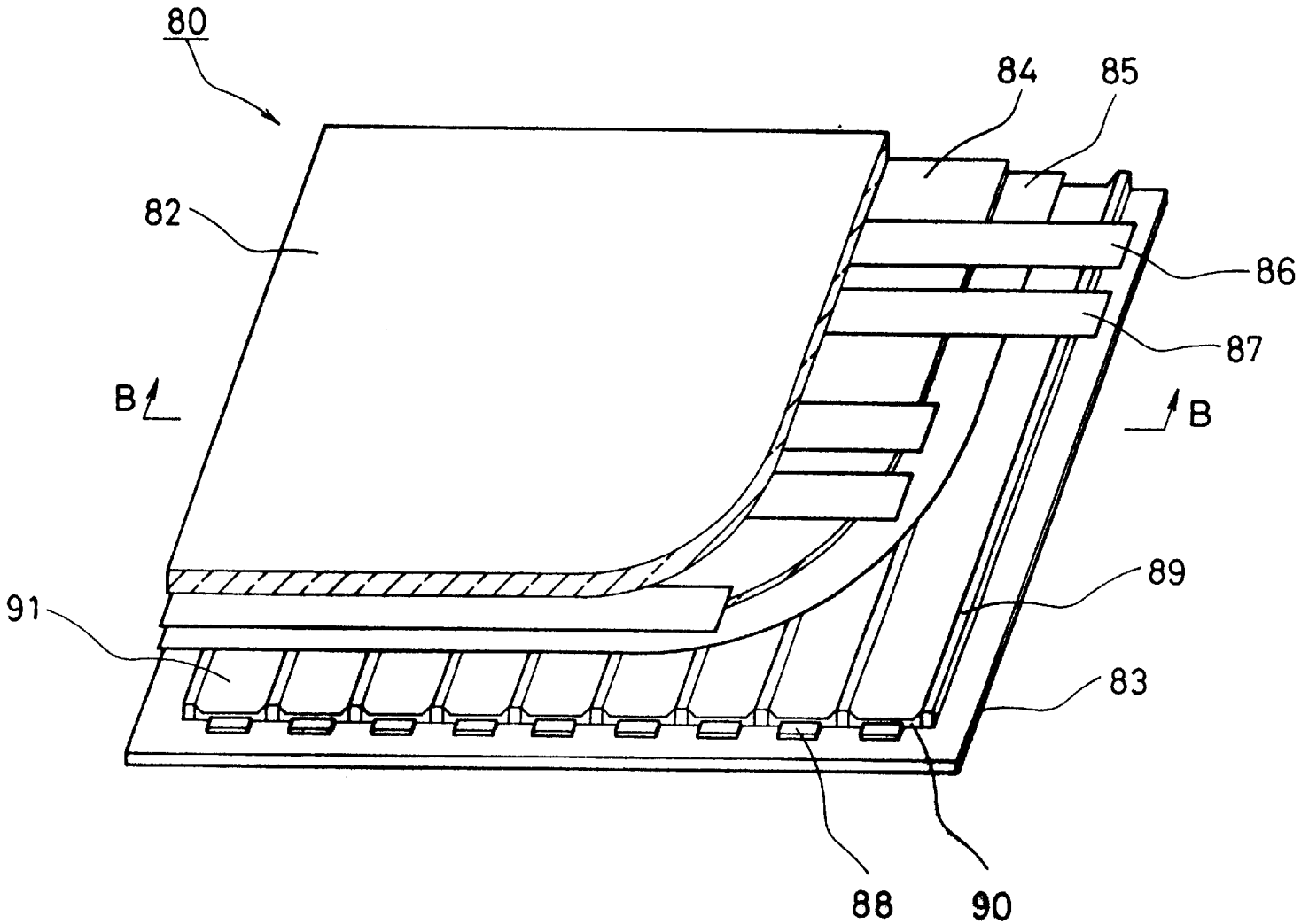
FIG. 11 is a partially broken perspective view illustrating the conventional AC type plasma display panel.
Figure 12:
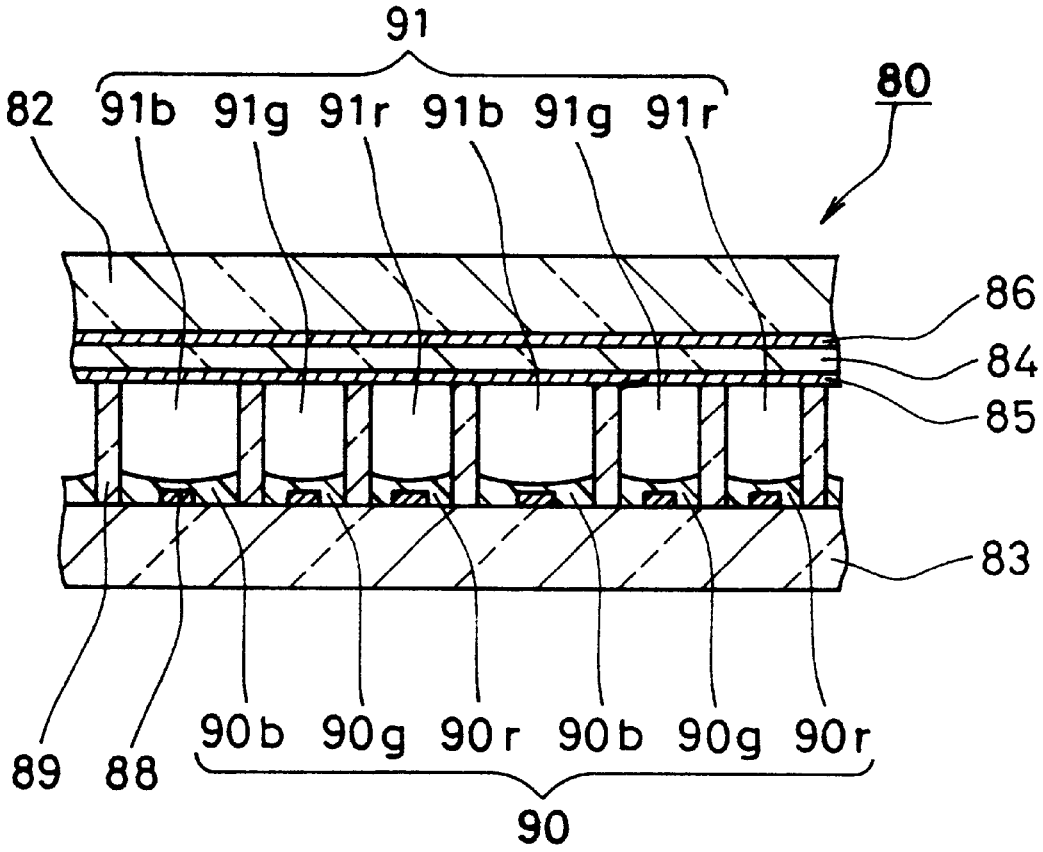
FIG. 12 is a cross sectional view of FIG. 11 along the line B—B taken in an arrow direction.

The following is a description of another embodiment with reference to FIG. 10.

An AC type plasma display panel in accordance with the present embodiment (hereinafter, simply referred to as "a panel") has the same configuration with the panel of the above embodiment shown in FIG. 4. The present embodiment is different from the above embodiment only in that an electric potential of the scanning electrode 6 is raised sharply to a certain value in the initialization period, followed by applying an inclined voltage.

As is shown in FIG. 6, voltage Ve−Vw being applied to the discharge space reaches the discharge starting voltage Vf at time t2, and a wall voltage begins to be formed at the same time the discharge begins. In other words, the period before the discharge begins (the period before time t2) is wasteful. Thus, in the present embodiment, as is shown in FIG. 10, voltage having a sharp waveform is applied to the scanning electrode 6 so that the relative electric potential Ve of the scanning electrode 6 to the sustaining electrode 7 rises sharply to the value slightly below the discharge starting voltage, and then an inclined voltage having a gentle gradient is applied.

This shortens the initialization period and extends the time that can be allocated to the sustain period, making it possible to increase emission brightness.

As is described above, the present embodiment can provide the AC type plasma display panel that improves the quality of white display, as well as can perform a stable write operation even if the write voltage (address voltage) is made uniform in the discharge cells of all colors in the address period, thereby realizing a stable display and further increasing emission brightness.

Although the above embodiment described the case where a blue discharge cell is wider than the other discharge cells, the width of discharge cells may be changed with the ratio different from that of the above embodiment depending on the chromaticity of desired white display. Also, depending on the characteristics of phosphors used, there are some cases where a discharge cell should have a width different from that of the above embodiment.

Also, the above embodiment described the case of applying the voltage waveform having an inclined portion that gradually increases and then decreases with respect to the sustaining electrode and the address electrode to all the scanning electrodes. However, the same effect also can be achieved in the case of applying the voltage waveform having an inclined portion that gradually increases and then decreases with respect to the scanning electrode and the address electrode to all the sustaining electrodes or in the case of applying the voltage waveform having an inclined portion that gradually increases and then decreases with respect to the scanning electrode and the sustaining electrode to all the address electrodes.

Furthermore, the waveform that gradually increases and then decreases was described as a voltage waveform in the initialization period. However, the same effect also can be achieved even with a waveform different from that of the above embodiment by designing an inclined voltage waveform so that the residual voltage Vg of the discharge cell at the end of the initialization period substantially corresponds to the discharge starting voltage Vf of the corresponding discharge cell.

In addition, the above embodiment described the panel in which a plurality of belt-like barriers are arranged substantially in parallel between the front substrate and the back substrate as an example, but the panel of the present invention is not limited to such a configuration. For instance, the panel may be configured by arranging a plurality of substantially parallel belt-like barriers in the longitudinal and transverse directions so as to cross each other (that is, substantially as a lattice). In this case, the address electrodes are formed so as to be substantially in parallel to either longitudinal barriers or transverse barriers, and the sustaining electrodes and the scanning electrodes are formed so as to be in the direction perpendicular to the address electrodes. The width of the discharge cell here means the one in the same direction as the width direction of the address electrode.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. An AC type plasma display panel comprising:

two substrates opposing each other with barriers interposed therebetween, a plurality of discharge cells surrounded by the two substrates and the bafflers, and a phosphor formed in each of the discharge cells;

wherein a width of the discharge cell in which the phosphor having at least one color of a plurality of colors is formed is different from a width of the discharge cell in which the phosphor having another color is formed, and a residual voltage in the discharge cell is made substantially equal to a discharge starting voltage of the discharge cell at the time an initialization period followed by an address period is completed.

2. The AC type plasma display panel according to claim 1, wherein an address electrode is formed on one of the two substrates in the discharge cell, a sustaining electrode and a scanning electrode are formed on the other substrate in a direction perpendicular to the address electrode, and a voltage waveform having a portion changing gradually is applied in an initialization period followed by an address period.

3. The AC type plasma display panel according to claim 2, wherein the portion changing gradually in the voltage waveform applied in the initialization period followed by the address period has a portion of voltage increase and a portion of voltage decrease.

4. The AC type plasma display panel according to claim 2, wherein the portion changing gradually in the voltage waveform applied in the initialization period followed by the address period has a portion of a voltage change rate that is 10 V/μs or smaller.

* * * * *